US006647953B1

(12) United States Patent
Langewisch

(10) Patent No.: US 6,647,953 B1
(45) Date of Patent: Nov. 18, 2003

(54) HYDRAULIC SYSTEM VOLUME REDUCER

(75) Inventor: Edwin H. Langewisch, Dunlap, IL (US)

(73) Assignee: Caterpillar Inc, Peoria, IL (US)

( * ) Notice: Subject to any disclaimer, the term of this patent is extended or adjusted under 35 U.S.C. 154(b) by 143 days.

(21) Appl. No.: 09/943,231

(22) Filed: Aug. 30, 2001

(51) Int. Cl.[7] ..... F02D 13/04

(52) U.S. Cl. ..... 123/321; 123/319; 60/584; 60/591

(58) Field of Search ..... 123/319, 320, 123/321, 90.12, 90.15, 90.16, 90.33, 90.36, 90.43, 90.44, 90.46, 90.55

(56) References Cited

U.S. PATENT DOCUMENTS

| | | | | |
|---|---|---|---|---|
| 2,545,258 A | | 3/1951 | Caillous | 60/54.5 |
| 2,669,843 A | | 2/1954 | Broadway | 60/54.5 |
| 2,674,096 A | | 4/1954 | Marshall | 60/54.5 |
| 3,424,154 A | | 1/1969 | Kinsley | 128/173 |
| 3,559,406 A | | 2/1971 | Gardner | 60/54.5 |
| 3,564,842 A | | 2/1971 | Van Marle | 30/10.5 |
| 3,800,538 A | | 4/1974 | Jones | 60/562 |
| 4,526,000 A | | 7/1985 | Saurwein | 60/540 |
| 4,681,021 A | | 7/1987 | Heinemann et al. | 91/178 |
| 5,058,385 A | * | 10/1991 | Everett, Jr. | 60/571 |
| 5,161,449 A | * | 11/1992 | Everett, Jr. | 91/42 |
| 5,485,819 A | * | 1/1996 | Joko et al. | 123/321 |
| 5,653,316 A | * | 8/1997 | Kane | 188/352 |
| 5,722,744 A | * | 3/1998 | Kupfer et al. | 303/189 |
| 5,996,550 A | * | 12/1999 | Israel et al. | 123/322 |
| 6,415,752 B1 | * | 7/2002 | Janak | 123/90.12 |

* cited by examiner

*Primary Examiner*—John Kwon
(74) *Attorney, Agent, or Firm*—Todd T Taylor

(57) ABSTRACT

A volume reducer for a hydraulic system, particularly useful for low pressure hydraulic systems such as used in engine compression braking systems. The hydraulic system has an actuator and a pressurizer, with a hydraulic line interconnecting the actuator and the pressurizer. A substantially straight section of the hydraulic line is provided, and a slidable body is provided in the substantially straight section. The body slides in the hydraulic line in response to pressure changes in the hydraulic line, and occupies hydraulic line volume, to stiffen the hydraulic system and reduce system sluggishness.

21 Claims, 1 Drawing Sheet

HYDRAULIC SYSTEM VOLUME REDUCER

TECHNICAL FIELD

The present invention relates to hydraulic systems, and more specifically to a low pressure hydraulic system for an engine compression braking system.

BACKGROUND

Work machines commonly use hydraulic actuators, such as hydraulic motors and hydraulic pistons, as drive and operating mechanisms to perform work. A pressurizer, such as a pump or master cylinder supplies hydraulic fluid under pressure to the actuator. Hydraulic lines, which may be tubes, hoses, pipes or the like are used to interconnect the various devices in the hydraulic system, including the pressurizer and the actuator. For proper operation, the system, including all hydraulic lines, must be full of hydraulic fluid. In some machines, the hydraulic lines may be quite long, extending between devices. Long runs of hydraulic lines are often relatively straight, and are known to encompass drilled passages through metal bodies forming part of the work machine.

A known application for a hydraulic system is in the actuation of an engine compression brake. When required, the engine compression brake is actuated to open cylinder valves of the engine. The hydraulic system for an engine compression brake is known to include a bridge operating one or more engine cylinder valves, with movement of the bridge accomplished through the use of a hydraulic line circuit. A slave piston in the hydraulic circuit is connected to the bridge, and is moved in response to movement of a master piston also in the circuit. Passages drilled through the engine valve cover may be used to form part of the hydraulic fluid lines for the system. A sump and pressurized fluid supply are provided, with appropriate valves for effectively turning the hydraulic system on or off.

It is known to use multiple pistons in a hydraulic cylinder, including one or more floating pistons, for various purposes, including the operation of multiple branch circuits from a single master cylinder. U.S. Pat. No. 3,800,538 entitled, "Master Cylinders For Hydraulic Braking Systems", discloses a master cylinder having a main first piston and two floating pistons collectively urged by a plurality of springs disposed in the cylinder.

A problem of hydraulic systems, particularly those operating at low pressures, is sponginess in response upon actuation of the system. This can occur due to the low bulk modulus of the hydraulic fluid at low pressures. Hydraulic systems used for engine compression brakes have been known to experience this type of problem.

The present invention is directed to overcoming one or more of the problems as set forth above.

SUMMARY OF THE INVENTION

In one aspect of the invention, a hydraulic system is provided with a pressurizer for pressurizing hydraulic fluid, an actuator responsive to pressurized fluid to perform work and a hydraulic fluid line interconnecting the pressurizer and the actuator. A volume reducer in the hydraulic fluid line includes a substantially straight section of the hydraulic fluid line and a body slidable in the straight section in response to pressure changes in the hydraulic fluid line.

In another aspect of the invention, an engine compression braking system for an engine is provided with a cylinder valve, an actuator operating on the valve responsive to pressurized fluid, and a pressurizer for pressurizing hydraulic fluid. A hydraulic fluid line interconnects the pressurizer and the actuator. A volume reducer in the hydraulic fluid line includes a body slidable in the hydraulic fluid line in response to pressure changes in the hydraulic fluid line.

In still another aspect of the invention, a method for operating a hydraulic system with reduced hydraulic fluid volume is provided, with steps of providing a pressurizer for pressurizing hydraulic fluid and an actuator responsive to pressurized fluid to perform work; providing a hydraulic fluid line interconnecting the pressurizer and the actuator; providing a body in the hydraulic fluid line; pressurizing fluid in the hydraulic fluid line; and sliding the body in the hydraulic fluid line in response to pressure changes in the hydraulic fluid line.

In yet another aspect of the invention, a volume reducer for a hydraulic circuit is provided with a substantially straight hydraulic fluid line, and a body freely slidable in the hydraulic fluid line in response to pressure changes in the hydraulic fluid line.

DETAILED DESCRIPTION

Figure 1:
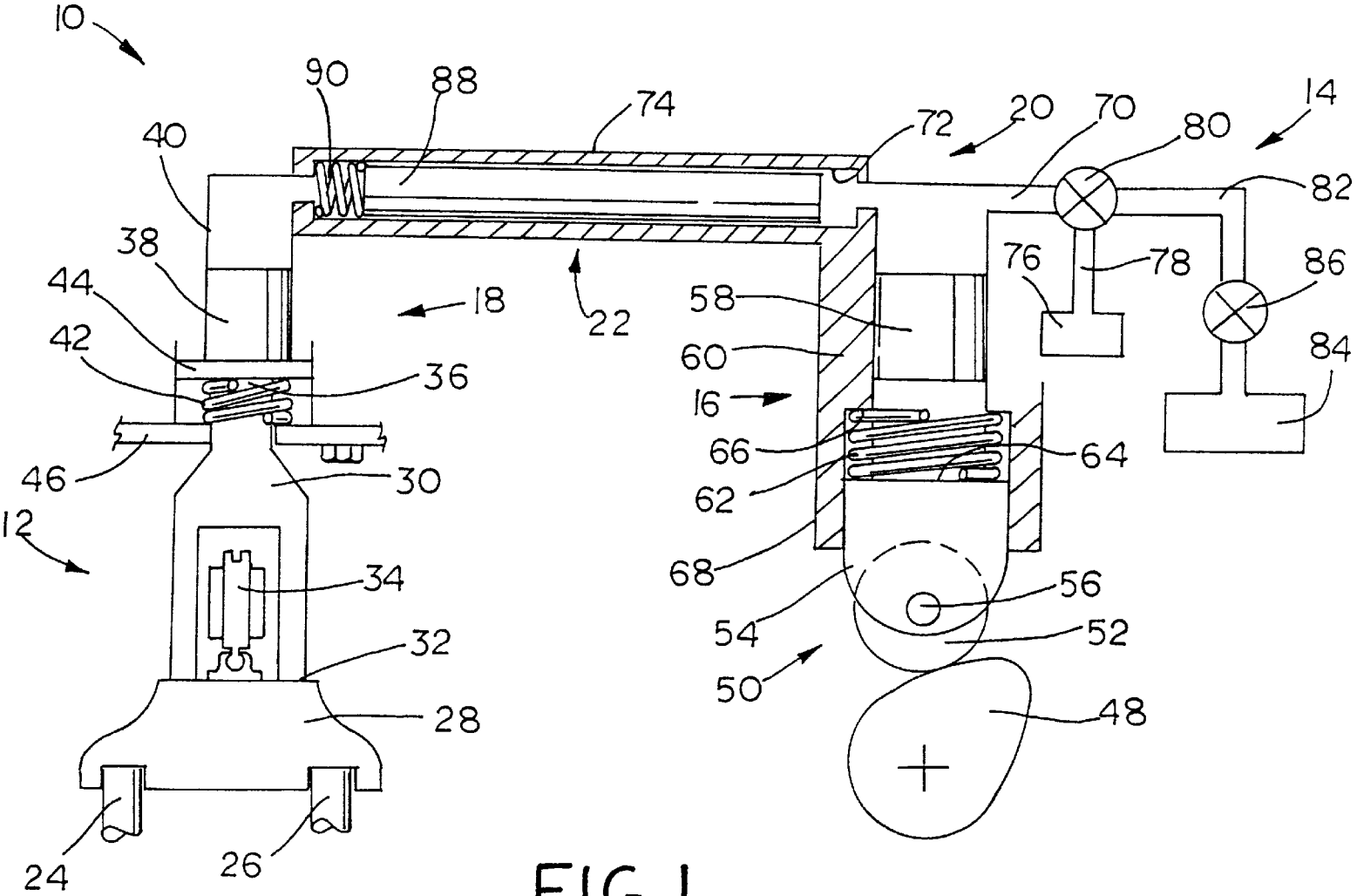
FIG. 1 is a schematic illustration of an compression engine brake and a hydraulic system including a volume reducer in accordance with the present invention.

Referring now to the drawing, FIG. 1 illustrates an engine compression braking system 10 including an engine compression brake 12 operated by a hydraulic system 14. Hydraulic system 14 includes a pressure generating section which shall be referred to herein as a pressurizer 16, and an acting section referred to herein as an actuator 18. Hydraulic system 14 further includes a hydraulic circuit 20 between pressurizer 16 and actuator 18. Hydraulic circuit 20 has a hydraulic system volume reducer 22 in accordance with the present invention.

Hydraulic circuit 20 is merely one example of a hydraulic circuit in which volume reducer 22 of the present invention can be used advantageously. Volume reducer 22 can be used in types and designs of hydraulic systems different from hydraulic system 14, and can be used for purposes other than actuation of an engine compression braking system 10. Compression braking system 10 and hydraulic system 14, to be described hereinafter, should not be construed as limitations on the use or application of the invention, nor on the breadth of the claims to follow.

Hydraulic circuit 20 extends between pressurizer 16 and actuator 18 to enable the activation or operation of pressurizer 16 to effect the required work to be performed by actuator 18. In the example shown, the work performed by actuator 18 is the operation of an engine compression brake 12. Those skilled in the art will recognize that FIG. 1 illustrates a simplified engine compression brake 12.

Actuator 18 operates simultaneously on two combustion cylinder valves 24 and 26 of an internal combustion engine (not shown), to open the valves and create engine braking when required. Actuator 18 includes a bridge 28 and a straddle 30. Bridge 28 extends between valves 24 and 26, and operatively engages the valves, transferring motion of bridge 28 equally to valves 24 and 26, so that when engine braking is required, both valve 24 and valve 26 are depressed by the operation of a single bridge 28. The manner in which depressing valves 24 and 26 creates engine braking is known to those skilled in the art, is not relevant to an understanding of the present invention, and will not be described in greater detail herein.

Straddle 30 operates against bridge 28, at one end 32 of straddle 30, and straddles a rocker arm 34 on bridge 28. On an end 36 of straddle 30 opposite bridge 28 and end 32, straddle 30 is connected to a slave piston 38 operating in a slave piston cylinder 40 of hydraulic system 14. Straddle 30 thereby transfers movement of slave piston 38 to bridge 28. A spring 42 operates between a flange 44 on end 36 of straddle 30, and a fixed abutment 46 to bias straddle 30 away from bridge 28.

Pressurizer 18 includes a cam 48 and a cam follower 50 including a roller 52 in a yoke 54. Roller 52 rotates about a pin 56 secured in yoke 54, and follows the surface of cam 48. Those skilled in the art will recognize that other types of cam and cam follower constructions can be used, include sliding or slipping surfaces, rather than the rolling surface of roller 52.

Cam follower 50 is connected to a master piston 58 operating in a master piston cylinder 60 of hydraulic system 14. Rotation of cam 48 thereby induces linear motion in master piston 58. A spring 62 operates between an end 64 of yoke 54 and an abutment 66 of a housing 68, to bias cam follower 50 toward cam 48.

Hydraulic circuit 20 includes a hydraulic fluid line 70 extending between master piston cylinder 60 and slave piston cylinder 40. A portion of hydraulic line 70 includes a bore 72 drilled in a valve cover 74 of the engine (not shown). Hydraulic line 70 is connected further to a hydraulic fluid sump 76 in a branch line 78. A solenoid valve 80 is provided in hydraulic line 70, and selectively connects hydraulic line 70 to branch line 78 and thereby sump 76, or to a supply line 82 from a pressurized supply 84 of hydraulic fluid. Supply line 82 includes a poppet valve 86. Pressurized supple 84 provides pressurized hydraulic fluid for hydraulic circuit 20, in known manner.

To reduce the sponginess in response of hydraulic circuit 20, volume reducer 22 is provided, and includes a sliding body 88 disposed in bore 72. Body 88 can be provided in any straight section of hydraulic line 70, and is used preferably in a rigid straight section, such as in a pipe or tube (not shown) or in bore 72. Body 88 is an elongate body, in the nature of a plug or slug, and is shaped on the outer surface thereof to slide smoothly and freely in bore 72. Body 88 may be solid, or may be hollow, but if hollow should define a sealed inner space, and must be sufficiently strong to withstand the pressure in hydraulic line 70 without collapsing or rupturing. Steel is a suitable material for body 88. A spring 90 lightly biases body 88 toward master piston 58.

INDUSTRIAL APPLICABILITY

In the use of compression braking system 10, pressurizer 16 of hydraulic system 14 activates actuator 18 to cause operation of compression brake 12. Actuator 18 opens valves 24 and 26 of the engine (not shown).

Pressurized supply 84 provides pressurized hydraulic fluid to hydraulic line 70, and thereby to master piston cylinder 60, and slave piston cylinder 40, which are filled with pressurized hydraulic fluid above master piston 58 and slave piston 48, respectively. Solenoid valve 82 has a "normally open" position, connecting hydraulic line 70 to sump 76 via branch line 78, and a "normally closed" position connecting hydraulic line 70 to pressurized supply 84 via supply line 82.

With solenoid valve 80 in the "normally " open position, compression braking system 10 is off, and supply pressure from pressurized supply 84 is blocked. Access to sump 76 is open, and both slave piston 38 and master piston 58 are drawn away from the valve operating train.

With solenoid valve 80 in the "normally closed" position, compression braking system 10 is on, and supply pressure from pressurized supply 84 is transmitted to hydraulic line 70. Access to sump 76 is blocked, and pressurized hydraulic fluid pushes slave piston 38 against the valve operating train, including straddle 30 and bridge 28.

Master piston 58 and slave piston 38 operate in the known master/slave hydraulic system relationship, such that linear motion of master piston 58 in master piston cylinder 60 is transferred to slave piston 38 in slave piston cylinder 40. Rotation of cam 48 builds and relieves pressure in hydraulic circuit 20. As roller 52 rides against an outwardly extending lobe of cam 48, master piston 58 is moved upwardly in master piston cylinder 60. The corresponding effect, transmitted through the pressurized hydraulic fluid in hydraulic line 70, is a downward movement of slave piston 38 in slave piston cylinder 40. Straddle 30 is moved downwardly, against bridge 28, the downward movement of which depresses valves 24 and 26. Conversely, as roller 52 rides away from an outwardly extending lobe of cam 48, master piston 58 moves downwardly in master piston cylinder 60. The corresponding effect is an upward movement of slave piston 38 in slave piston cylinder 40. Straddle 30 is moved upwardly, away from bridge 28. The downward movement of master piston 58 and the upward movement of straddle 30 are assisted by spring 62 and spring 42, respectively.

Body 88 displaces hydraulic fluid in hydraulic circuit 20. As pressure builds on the master piston side of body 88, such as when cam follower 50 encounters a lobe of cam 48 as described above, body 88 is moved toward slave piston cylinder 40, transmitting the pressurization to the hydraulic fluid on the slave piston side of body 88, effecting slave piston movement as described above. Conversely, the hydraulic effects occurring from the movement of a lobe of cam 48 away from cam follower 50 result in the movement of body 88 toward master piston cylinder 60.

By occupying volume in hydraulic line 70, which otherwise would have to be filled with hydraulic fluid, body 88 reduces the required volume of hydraulic fluid. Hydraulic circuit 20 is thereby made stiffer, and responds more quickly to activation from master piston 58. Body 88 can be used in any straight section of a hydraulic circuit, to reduce the required volume of hydraulic fluid, and thereby increase hydraulic system stiffness.

Other aspects, objects and advantages of this invention can be obtained from a study of the drawings, the disclosure and the appended claims.

What is claimed is:

1. A hydraulic system comprising:

a pressurizer for pressurizing hydraulic fluid;

an actuator responsive to pressurized fluid to perform work;

a hydraulic fluid line interconnecting said pressurizer and said actuator; and a volume reducer in said hydraulic fluid line, said volume reducer including a substantially straight section of said hydraulic fluid line and a body freely slidable in said straight section in response to pressure changes in said hydraulic fluid line, said body configured with and arranged in said straight section for reducing the volume of hydraulic fluid required for operating said system by transmitting pressurization of hydraulic fluid in said fluid line on one side of said body to hydraulic fluid in said fluid line on an opposite side of said body.

2. The hydraulic system of claim 1, said actuator including a slave piston.

3. The hydraulic system of claim 2, said pressurizer including a master piston.

4. The hydraulic system of claim 3, said volume reducer including a spring biasing said body toward said master piston.

5. The hydraulic system of claim 1, said pressurizer including a master piston.

6. The hydraulic system of claim 5, said volume reducer including a spring biasing said body toward said master piston.

7. The hydraulic system of claim 1, said volume reducer including a spring biasing said body toward said pressurizer.

8. An engine compression braking system for an engine, said engine braking system comprising:

a cylinder valve;

an actuator operating on said valve responsive to pressurized fluid;

a pressurizer for pressurizing hydraulic fluid;

a hydraulic fluid line interconnecting said pressurizer and said actuator; and a volume reducer in said hydraulic fluid line, said volume reducer including a substantially straight section of said hydraulic fluid line, and a body freely slidable in said substantially straight section in response to pressure changes in said hydraulic fluid line, said body configured with and arranged in said straight section for reducing the volume of hydraulic fluid required for operating said system by transmitting pressurization of hydraulic fluid in said fluid line on one side of said body to hydraulic fluid in said fluid line on an opposite side of said body.

9. The engine compression braking system of claim 8, said pressurizer including a master piston, and said actuator including a slave piston.

10. The engine compression braking system of claim 8, including a valve cover for the engine, and said hydraulic fluid line including a bore in said valve cover, and said body slidably disposed in said bore.

11. The engine compression braking system of claim 10, said pressurizer including a master piston, and said actuator including a slave piston.

12. The engine compression braking system of claim 11, said actuator including a bridge operatively disposed against said valve, and a straddle connecting said bridge and said slave piston.

13. The engine compression braking system of claim 12, including a second cylinder valve, and said bridge engaging said cylinder valve and said second cylinder valve.

14. The engine compression braking system of claim 13, said volume reducer having a spring biasing said body toward said master piston.

15. The engine compression braking system of claim 13, said pressurizer having a spring biasing said master piston away from said body.

16. The engine compression braking system of claim 13, said actuator having a spring biasing said slave piston toward said body.

17. The engine compression braking system of claim 8, said volume reducer having a spring biasing said body toward said pressurizer.

18. The engine compression braking system of claim 8, said body being steel.

19. A method for operating a hydraulic system with reduced hydraulic fluid volume, comprising:

providing a pressurizer for pressurizing hydraulic fluid and an actuator responsive to pressurized fluid to perform work;

providing a hydraulic fluid line interconnecting the pressurizer and the actuator; and reducing the volume of fluid required for operating the system by providing a body freely slidable in the hydraulic fluid line;

pressurizing fluid in the hydraulic fluid line;

sliding the body in the hydraulic fluid line in response to pressure changes in the hydraulic fluid line; and transmitting pressurization of hydraulic fluid in the fluid line on one side of the body to hydraulic fluid in the fluid line on an opposite side of the body.

20. The method of claim 19, including providing a spring operatively engaging the body, and biasing the body toward the pressurizer.

21. A volume reducer for a hydraulic circuit comprising:

a substantially straight hydraulic fluid line in the circuit; and a body freely slidable in said hydraulic fluid line in response to pressure changes in said hydraulic fluid line, said body configured with and arranged in said fluid line for reducing the volume of hydraulic fluid required for operating said circuit by transmitting pressurization of hydraulic fluid in said fluid line on one side of said body to hydraulic fluid in said fluid line on an opposite side of said body.

* * * * *